United States Patent [19]

Walton, II

[11] 4,216,668

[45] Aug. 12, 1980

[54] CRIMPING TOOL HEAD

[75] Inventor: Charles E. Walton, II, Downingtown, Pa.

[73] Assignee: Burroughs Corporation, Detroit, Mich.

[21] Appl. No.: 25,940

[22] Filed: Apr. 2, 1979

[51] Int. Cl.[3] ..... B21D 37/12

[52] U.S. Cl. ..... 72/412; 29/753; 72/410

[58] Field of Search ..... 72/412, 410, 409, 402, 72/414; 29/753, 754, 748, 750

[56] References Cited

U.S. PATENT DOCUMENTS

| | | | |
|---|---|---|---|
| 3,253,451 | 5/1966 | Kerns | 72/412 |
| 3,616,674 | 11/1971 | Piasecki | 72/410 |
| 3,837,211 | 9/1974 | Gress | 72/410 |
| 4,048,839 | 9/1977 | Peterpaul | 29/753 |
| 4,139,937 | 2/1979 | L'Homme | 29/748 |

*Primary Examiner*—Francis S. Husar
*Assistant Examiner*—Gene P. Crosby
*Attorney, Agent, or Firm*—Mark T. Starr

[57] ABSTRACT

A crimping head for use in tools for crimping removable crimp style electrical socket contacts is disclosed. The head includes a tail crimper affixed to a frame for shaping the contact's tail section into a probe hook. A tail anvil, slidably mounted on the frame and engagable against the tail crimper, compresses the tail section against the tail crimper to form the probe hook. Upper and lower crimping jaws, attached to the tail crimper and tail anvil, respectively, crimp the contact onto the end of a wire as the tail section is simultaneously formed into the probe hook.

14 Claims, 6 Drawing Figures

CRIMPING TOOL HEAD

BACKGROUND OF THE INVENTION

This invention relates in general to an improved crimping head for use in both hand operated and semiautomatic crimping machines. In particular, the head finds use in crimping removable crimp style electrical socket contacts of the type designed to mate with square or round pin contacts. Typical of such contacts are those manufactured by Berg Electronics, Inc. and marketed under the trade name of Berg Spot-O-Gold Mini PV Contacts.

Mini PV contacts are available in either loose piece or continuous strip form depending on whether they are to be utilized with a hand operated or semiautomatic crimping machine, respectively. Typically, contacts such as the Berg Spot-O-Gold include a donut shaped connecting piece which is used to interconnect the contacts when they are in strip form. When a strip of contacts is cut into loose piece form, the donut shaped connecting piece (tail section) remains attached to each contact.

When used in a hand operated crimping tool, the connecting tail is cut off and discarded prior to crimping the contact. Similarly, when the contacts are utilized in strip form, for example, in a semiautomatic crimping machine, the connecting tail is automatically cut off as the crimping operation is performed.

Crimping tools for crimping mini PV contacts to the prestripped end of insulated wires are known in the prior art. Typical of such tools are the Berg Electronics, Inc. Models HT-95, PV-200 and PV-250. The Model HT-95 is a hand operated tool and in use each contact's tailpiece is normally cut off by the operator prior to inserting the contact in the tool. In the Models PV-200 and PV-250, both of which are semiautomatic machines, the contact tailpiece is automatically cut off as the contact is crimped onto a wire.

As previously mentioned, mini-PV contacts are used to connect electrical wire conductors to square or round pin contacts. Often, these pin contacts are in close proximity to each other and consequently so are the mini-PV contacts which plug onto the pin contacts. This condition makes it difficult to access the mini-PV contacts with a voltmeter or oscilloscope probe. This undesirable condition is compounded by the fact that in the prior art the crimped mini-PV contacts do not provide a hook on which to attach an electrical probe.

It is a general object of the present invention to overcome these and other drawbacks of the prior art by providing an improvement to the Berg crimping tool which forms a probe hook from the tailpiece of a mini-PV contact while simultaneously crimping the contact on a wire conductor.

It is an additional object of the present invention to provide a crimping tool head for crimping mini-PV contacts which does not require removal of the contact's tail section prior to crimping the contact on a wire.

These and other objects, features and advantages of the present invention will become more apparent from the detailed description of the preferred embodiment when read in conjunction with the drawings.

SUMMARY OF THE INVENTION

In accordance with the present invention, there is provided a head for use in a crimping tool which crimps a removable crimp style electrical socket contact to the stripped end of an insulated electrical wire and simultaneously forms a probe hook from the uncrimped tail section of the contact.

The head finds use in both hand operated and semiautomatic crimping machines designed to crimp removable crimp style electrical socket contacts of the type designed to mate with square or round pin contacts. Such contacts are typically produced in strip form and may include a donut shaped tail section, the purpose of which is to connect a pair of contacts to form the strip. In prior art semiautomatic crimping machines, the tail section is normally automatically cut off as the crimping operation is performed. In typical hand operated crimping tools, the tail section is cut off by the operator prior to inserting the contact in the tool.

The crimping head of the present invention includes an inverted U-shaped frame. Rigidly connected to one side of the frame's cross-member is a tail crimper which shapes the contact's tail section into a probe hook as the contact is crimped on a wire. Connected to one side of the tail crimper is an upper crimping jaw. The upper crimping jaw includes two crimpers, one for shaping the section of the contact which is to be crimped on the stripped portion of the wire and one for shaping the section of the contact which is to be crimped on the unstripped section of the wire.

Journeled between the opposed inner surfaces of the frame's legs is a lower crimping jaw which may be slid between the frame's legs to engage the upper crimping jaw and thus crimp the contact onto the wire. The lower crimping jaw includes an anvil which is positioned to oppose the two crimpers of the upper crimping jaw. Connected to the lower crimping jaw is a tail anvil which is positioned to oppose the tail crimper and move into abutting contact with the tail crimper as the lower crimping jaw is engaged with the upper crimping jaw. Also connected to the tail anvil is a terminal holder which orients the contact in proper position to be crimped and formed.

To perform a crimping operation, the contact is inserted onto the terminal holder to align the contact between the two crimping jaws, and between the tail crimper and tail anvil. The stripped end of the wire is then inserted into the contact. Next, the lower crimping jaw is engaged with the upper crimping jaw. As the lower crimping jaw engages the upper crimping jaw, the lower crimping jaw's anvil crimps the connector around the wire by forcing the connector against the two crimpers of the upper crimping jaw. Simultaneously, as the lower crimping jaw is engaged against the upper crimping jaw, the surface of the tail anvil presses the tail section of the contact against the opposed surface of the tail crimper to form the contact's probe hook.

DESCRIPTION OF THE PREFERRED EMBODIMENT

Figure 1:
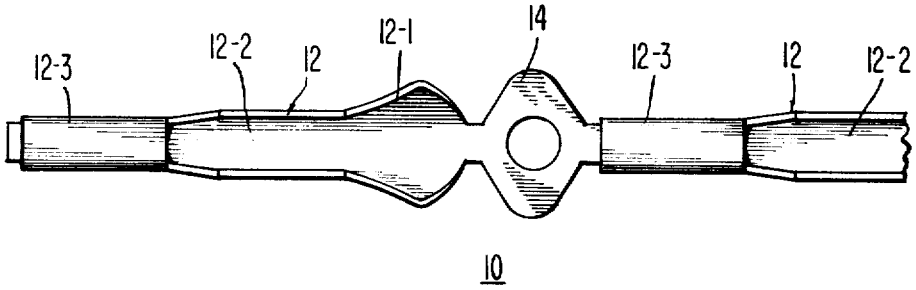
FIG. 1 is a plan view of a mini-PV contact connected to a second mini-PV contact in strip form.

Referring to FIG. 1, there is shown a plan view of a continuous strip 10 of uncrimped removable crimp style electrical socket contacts 12 of the type designed to mate with square or round pin contacts. The contacts 12 are normally available in a continuous strip form 10 for use in a semiautomatic crimping machine in which contacts 12 are automatically fed into the machine prior to the crimping operation.

The contacts 12 may also be utilized in a hand operated crimping tool in which case the strip 10 of contacts is cut between each of two contacts 12 to provide single contacts 12. The preferred embodiment of the present invention provides a head for use in a hand operated crimping tool. However, those skilled in the art will realize that the head disclosed may be adapted for use in a semiautomatic crimping machine.

Again referring to FIG. 1, in the prior art the contact tail section 14 is utilized to join the individual contacts 12 into a continuous strip 10 and provides a means of feeding the contacts 12 into the crimping head of a semiautomatic crimping machine. Once a contact 12 is fed into the prior art semiautomatic machine, the tail section 14 is severed from the contact 12 as the crimping operation is performed. In the prior art hand operated crimping tool, there is no provision for cutting off the contact's tail section 14 as the crimping operation is performed. As such, the operator normally will manually cut off the contact's tail section 14 prior to inserting the contact 12 in the crimping tool head.

The preferred embodiment of the present invention provides an improvement to the crimping head of prior art hand crimping tools in that it does not require the contact's tail section 14 to be cut off by the operator prior to insertion in the tool's head. Instead of cutting off the contact's tail section 14, as the present invention crimps a contact 12 onto a wire, it simultaneously forms the tail section 14 into a probe hook 14' and bends the tail hook 14' formed to approximately a 15 degree angle with respect to the remainder of the contact 12 (FIG. 2).

Figure 2:
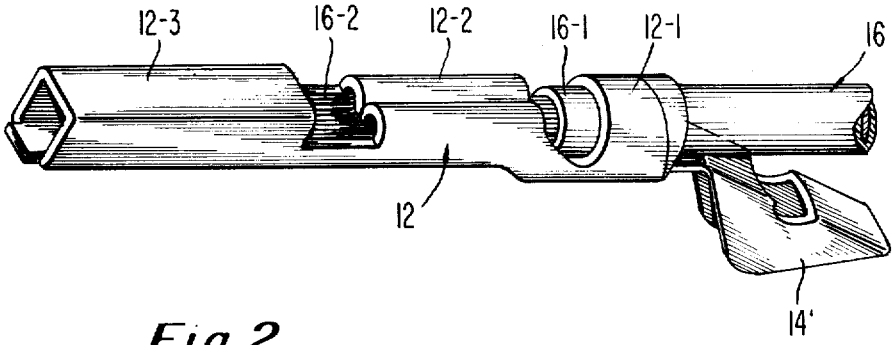
FIG. 2 is a pictorial view of a mini-PV contact crimped onto the stripped end of an insulated wire and having its tail section formed into a probe hook.

FIG. 2 pictorially illustrates a mini-PV contact 12 that has been crimped on the prestripped end of an insulated wire 16 and the probe hook 14' formed from the tail section 14 using the crimping head of the present invention. In accomplishing the crimping operation, two sections of the contact 12 and the tail section 14 are simultaneously operated upon. First, the probe hook 14' is formed from the contact's tail section 14 (FIG. 1). Second, the insulation support section 12-1 of the contact 12 is crimped around the insulated portion 16-1 of wire 16. Third, the wire barrel section 12-2 of the contact 12 is crimped around the stripped end 16-2 of wire 16. The mating end 12-3 of the contact 12 is unaltered during the crimping operation. In the following discussion, a description of how the present invention simultaneously performs all three operations will be presented.

Prior art hand crimping tools typically include a frame to which is affixed an upper crimping jaw, with a lower crimping jaw slidably mounted on the frame and engagable against the first crimping jaw. Additionally, such prior art tools include a pair of plier like handles which when squeezed together move the lower crimping jaw against the upper crimping jaw. The action of the lower crimping jaw being engaged against the upper crimping jaw crimps the contact which is positioned between the two jaws. The design of mechanisms for moving the lower crimping jaw into contact with the upper crimping jaw is well known to those skilled in the art. As such, the following discussion will only consider the crimping head of the present invention.

The crimping head of the present invention provides an improvement over prior art crimping heads by including additional means which form a probe hook 14' from the contact's tail section 14 as the contact 12 is crimped onto wire 16.

Figure 4:
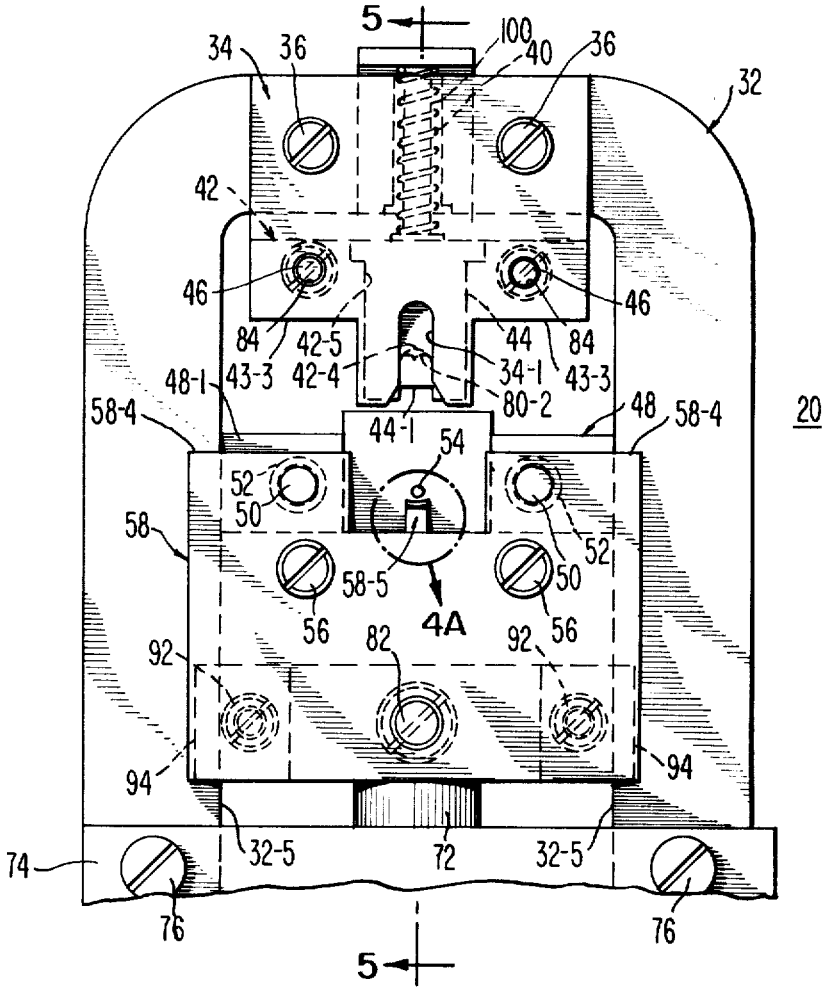
FIG. 4 is a front view of the unloaded crimping head.
Figure 5:
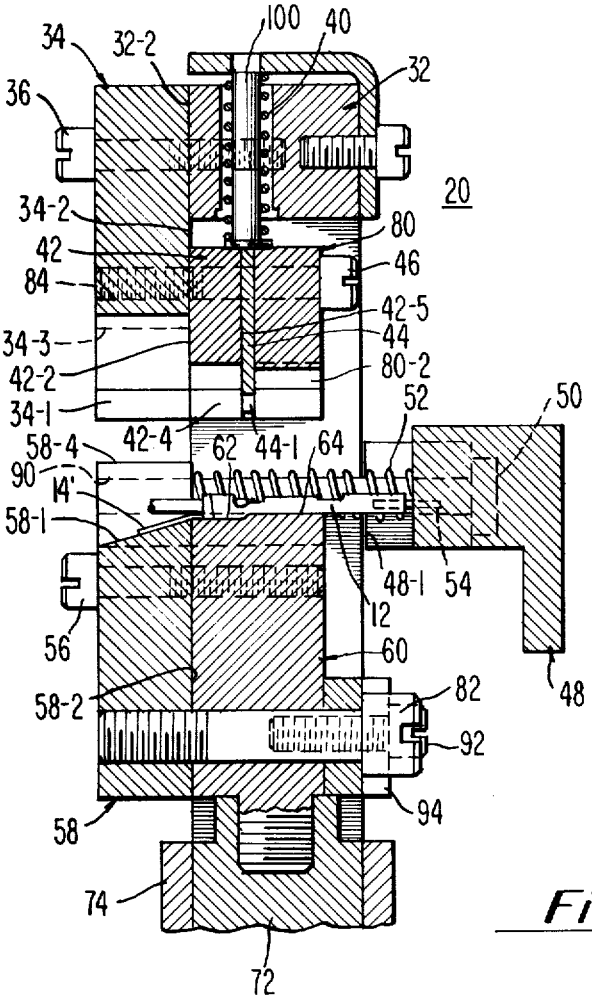
FIG. 5 is a section view taken along the lines 5—5 of FIG. 4 showing the crimping head in a disengaged position after completing a crimping operation.
Figure 4A:
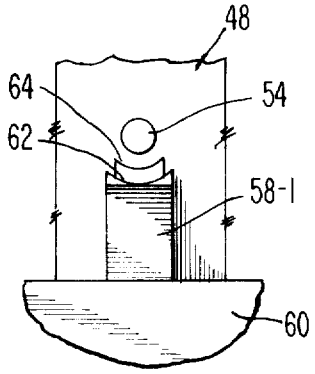
FIG. 4A is an enlarged view of a section of FIG. 4.
Figure 3:
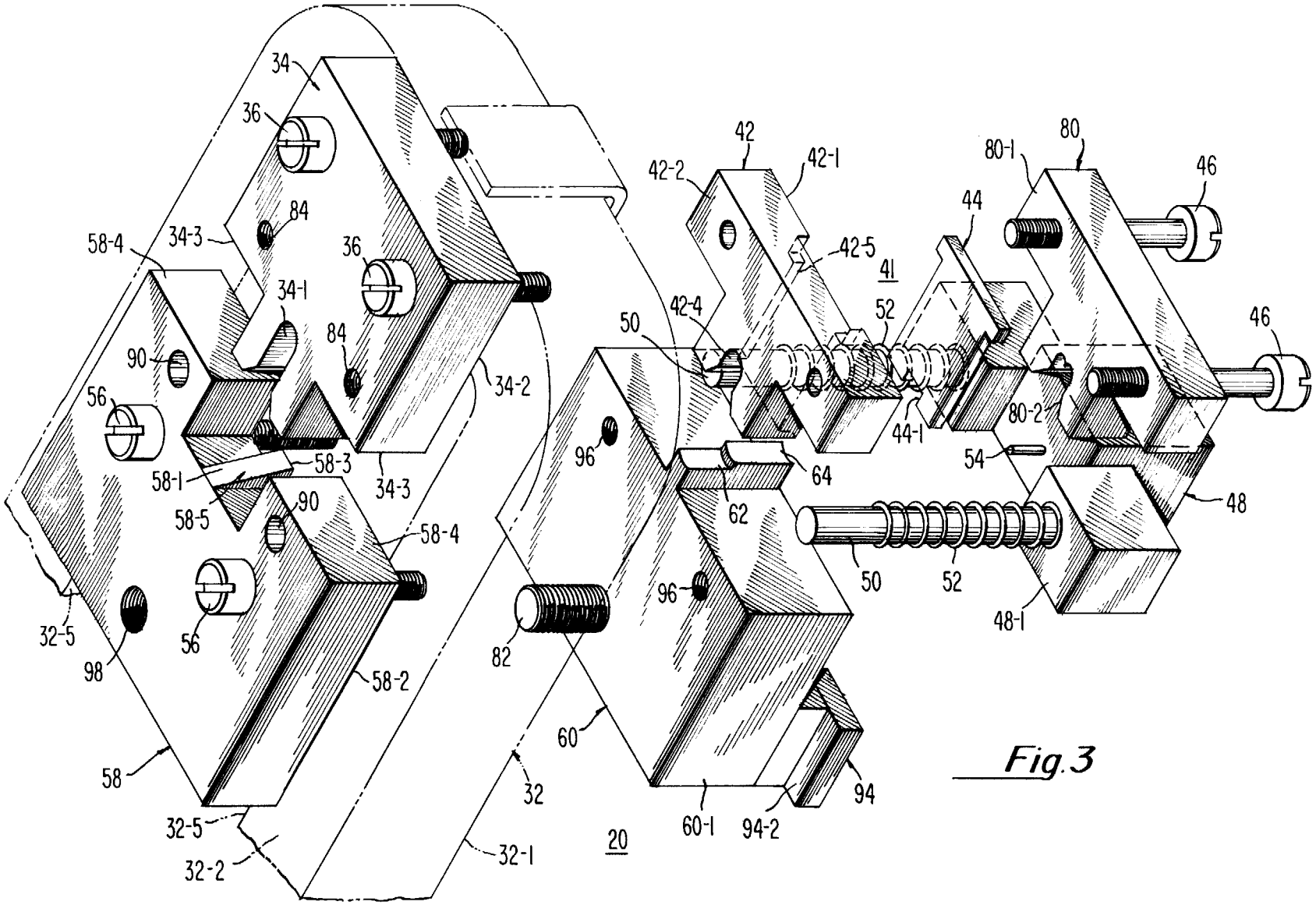
FIG. 3 is an exploded pictorial view of the crimping head of the present invention.

With reference now to the drawings and more particularly to FIGS. 3–5 thereof, there can be seen the detail of the construction and operation of the crimping head 20 of this invention.

A pictorial view of the components of the crimping tool head 20 of the present invention is shown in FIG. 3. The head 20 includes an inverted U-shaped frame 32 which may be attached to a hand tool's base 74 by bolts 76 (FIG. 4).

Referring again to FIG. 3, mounted on side 32-2 of of frame 32 is tail crimper 34. The tail crimper 34 is connected to the frame 32 by bolts 36 which screw into the corresponding threaded bores of holes in frame 32. The tail crimper 34 provides a shaping support for the contact's tail section 14 during the crimping operation.

The crimping head 20 additionally includes an upper crimping jaw 41, which in turn includes an insulation support crimper 42, a hold down 44, and a wire barrel crimper 80. The components of the upper crimping jaw 41 are connected to side 34-2 of tail crimper 34 by means of bolts 46 which mate with the corresponding threaded bores of holes 84 in tail crimper 34. Thus, surface 42-2 of insulation support crimper 42 is in abutting contact with surface 34-2 of tail crimper 34, and surface 80-1 of wire barrel crimper 80 is in abutting contact with surface 42-1 of insulation support crimper 42. Positioned between the confronting surfaces of the insulation support crimper 42 and the wire barrel crimper 80 and slidably mounted in track 42-5 of insulation support crimper 42, is hold down 44. The insulation support crimper 42 provides a die for crimping section 12-1 of the contact 12 around the insulated section 16-1 of wire 16, while wire barrel crimper 80 provides a die for crimping section 12-2 of the contact 12 around the stripped section 16-2 of wire 16 (FIG. 2). Hold down 44 provides a means for maintaining contact 12 in position as the crimping operation is accomplished.

The lower crimping jaw 60 is positioned on frame 32 with its ends 60-1 in slidable contact with the opposed inner surfaces 32-5 (FIG. 4) of the legs of frame 32 and with surfaces 94-2 of retaining sections 94 in slidable contact with the corresponding surfaces 32-1 of the legs of frame 32. Retaining sections 94 are connected to the lower crimping jaw 60 by means of bolts 92 which screw into the corresponding threaded bores of holes in lower crimping jaw 60. Positioned on the opposite side of frame 32 in slidable contact with surfaces 32-2 of the legs of frame 32 is tail anvil 58. Bolts 56 and 82 screw into corresponding threaded holes 96 and 98, respectively, to connect the confronting surfaces of the tail anvil 58 and the lower crimping jaw 60 such that the connected tail anvil 58/lower crimping jaw 60 combination is held in slidable contact with the legs of frame 32 (FIG. 4). Thus, the tail anvil 58 and lower crimping jaw 60 may be simultaneously slid along the vertical axis of the legs of frame 32 such that they may be moved to a position against the tail crimper 34 and upper crimping jaw 41 respectively. As the tail anvil 58 moves against the tail crimper 34, the tail anvil forms a probe hook 14' from the tail section 14 of a contact 12 that is properly positioned between surfaces 34-1 and 58-1. Simultaneously, as the lower crimping jaw 60 moves against the upper crimping jaw 41, contact sections 12-1 and 12-2 are crimped around wire sections 16-1 and 16-2, respectively.

A terminal holder 48 for properly positioning the contact 12 during the crimping/tail shaping operation is connected to the tail anvil 58 by rods 50 which are press fitted into corresponding holes 90 in tail anvil 58. The operation of the terminal holder 48 will be described below.

FIG. 4 shows a front view of the assembled crimping head 20. As will be further explained below, an uncrimped contact 12 may be inserted on pin 54 of terminal holder 48 and thus properly positioned preparatory to the crimping operation. With the contact 12 loaded in the crimping head 20, the operator next inserts the stripped end of the wire 16 into the contact 12. Once this has been accomplished, the operator next squeezes together a pair of plier-like handles (not shown), or equivalent means which has the effect of moving engaging rod 72 up with respect to frame 32 and base 74. The upward movement of engaging rod 72 causes the connected lower crimping jaw 60 and attached tail anvil 58 is slide along the legs of frame 32 toward the opposing upper crimping jaw 41 and tail crimper 34, respectively. As the lower crimping jaw 60 moves towards and engages the upper crimping jaw 41, the lower crimping jaw 60 presses contact sections 12-1 and 12-2 against the upper crimping jaw 41 whereby the contact 12 is crimped around wire 16. Simultaneously, as tail anvil 58 moves against the tail crimper 34, the contact's tail section 14 is formed into a probe hook 14'.

FIG. 5 represents a section view taken along the lines 5—5 of FIG. 4 and shows the crimping head 20 in a disengaged position after completing a crimping operation. The operation of the crimping head 20 will now be explained in more detail and with particular reference to FIG. 5.

With the head 20 in a disengaged position (FIG. 5), the operator first pushes terminal holder 48 towards frame 32. The force exerted by the operator on the terminal holder 48 overcomes the opposing force of bias springs 52 and the terminal holder 48 slides along guide rails 50 until surfaces 48-1 come into abutting contact with surfaces 58-2. While maintaining the terminal holder 48 in this engaged position, the operator inserts the mating end 12-3 of contact 12 onto pin 54 of terminal holder 48. The operator next inserts the wire 16 into the contact 12 such that the stripped portion 16-2 is positioned between uncrimped contact section 12-2 and the insulated portion 16-1 is positioned between uncrimped contact section 12-1. In the alternative, the operator may first insert the wire 16 into the contact 12 and then insert the mating end 12-3 of contact 12 onto pin 54. In either case, the operator next releases terminal holder 48. As the terminal holder 48 is released, compressed bias springs 52 push the terminal holder 48 to a disengaged position as shown in FIG. 5. The latter operation effectively positions the contact 12 in proper position for being crimped. With the tail crimper 48 in this disengaged position, section 12-2 of the uncrimped contact 12 is supported by lower crimping jaw surface 64, section 12-1 is supported by lower crimping jaw surface 62 and the mating end 12-3 remains on pin 54. At this time, contact tail section 14 has neither been formed or angled and thus it is aligned parallel with wire 16 and supported by edge 58-3 (FIG. 3) of tail anvil 58.

Referring again to FIG. 5, once the wire 16 loaded contact 12 has been inserted onto terminal holder 48, the operator next activates a mechanism (not shown) which moves element 72 towards the top cross-member of frame 32. Mechanisms for accomplishing the latter movement of element 72 are well known in the prior art and will not be considered in detail in this description. As member 72 is moved upward, the connected lower crimping jaw 60 and attached tail anvil 58 simultaneously slide upward along the legs of frame 32 until surfaces 58-4 (FIG. 3) of tail anvil 58 are in abutting contact with corresponding surfaces 34-3 of tail crimper 34. Before the tail anvil 58 contacts the tail crimper 34, surface 44-1 of hold down 44 contacts section 16-1 of the wire 16 and thus holds contact section 12-1 against lower crimping jaw 60 surfaces 62 and 64. As the tail anvil 58 continues to approach the tail crimper 34, hold down 44 slides upward in channel 42-5 so as not to interfere with surfaces 58-4 and 34-3 coming into abutting contact. In addition, as hold down 44 slides upwards in channel 42-5, it pushes rod 100 upward which in turn compresses bias spring 40.

As surface 58-4 approaches surface 34-3, contact tail section 14 is anviled between surface 34-1 of tail crimper 34 and the opposing surface of inclined plane 58-5 such that the tail section 14 is bent around the sides of inclined plane 58-5 to achieve the shape of a probe hook 14'. Further, as the tail section 14 is formed into probe hook 14', the probe hook 14' being formed is offset at an angle corresponding to the slope of inclined plane surface 58-1. Simultaneous with surface 58-4 moving toward abutting contact with surface 34-3, surface 62 of lower crimping jaw 60 anvils section 12-1 of contact 12 against surface 42-4 of insulation support crimper 42, thus crimping contact section 12-1 around the insulated section 16-1 of wire 16. Further, simultaneous with surface 58-4 moving toward abutting contact with surface 34-3, surface 64 of lower crimping jaw 60 anvils section 12-2 of contact 12 against surface 80-2 of wire barrel crimper 80, thus crimping contact section 12-2 around section 16-2 of wire 16.

The operator next releases the engaging mechanism (not shown), which causes engaging rod 72 to move away from the top cross-member of frame 32, thus restoring attached lower crimping jaw 60 and connected tail anvil 58 to their original position as shown in FIG. 5. As the lower crimping jaw 60 returns to its original position, hold down 44 is restored to its original position under the influence of bias spring 40 pushing down on rod 100.

After the crimping operation has been completed, the crimping head 20 is positioned as shown in FIG. 5. The operator may then remove the crimped contact 12 (and now connected wire 16) from pin 54, leaving the head 20 positioned to begin another crimping operation. At this point, contact sections 12-1 and 12-2 have been crimped onto wire sections 16-1 and 16-2, respectively, and the contact's tail section 14 has been formed into a probe hook 14' which has been offset at roughly a 15 degree angle.

Having shown and described the preferred embodiment of the crimping tool head 20 of the present invention, those skilled in the art will realize that various omissions, substitutions and changes in forms and details of the head 20 may be made without departing from the spirit of the invention. In addition, those skilled in the art will realize that with minor modifications the head 20 may be employed in a variety of hand operated and semiautomatic crimping machines which employ various means for activating engaging rod 72. It is the applicant's intention therefore, to be limited only by the scope of the following claims.

What is claimed is:

1. A crimping tool head for use in a tool for crimping electrical socket contacts of the type characterized as including a tail section, said head adapted for crimping one of said contacts onto the end of a prestripped insulated wire conductor and simultaneously forming a probe hook from the tail section of said contact, said head comprising:

a frame;

tail crimping means, coupled to said frame, for guiding the formation of said probe hook;

upper crimping means, coupled to said tail crimping means, for guiding the formation of the section of said contact which is to be crimped on said wire conductor;

tail anvil means, slidably coupled to said frame opposing said tail crimping means and engagable against the opposed surface of said tail crimping means, for compressing said tail section against said tail crimping means whereby said tail section is formed into said probe hook; and lower crimping means, slidably coupled to said frame opposing said upper crimping means and engagable with the opposed surface of said upper crimping means, for compressing the section of said contact which is to be crimped on said wire conductor against said upper crimping means.

2. The crimping tool head as defined in claim 1 further characterized in that said tail anvil means is connected to said lower crimping means, whereby as said tail anvil means is engaged against said tail crimping means, said lower crimping means is simultaneously engaged with said upper crimping means.

3. The crimping tool head in accordance with claim 2 wherein the surface of said tail anvil means opposing the surface of said tail crimper means is characterized as having a rectangular shaped cavity, the base of said cavity including an inclined planar shaped projection.

4. The crimping tool head in accordance with claim 3 wherein the surface of said tail crimper means opposing the surface of said tail anvil means is characterized as having a projecting rectangular shaped member, said member matable with the cavity in the opposed surface of said tail anvil means.

5. The crimping tool head in accordance with claim 4 wherein the surface of said projecting rectangular shaped member is characterized as having a notch to accommodate said inclined planar shaped projection and said wire.

6. The crimping tool head as defined in claim 2 further characterized in that:

said frame is essentially of an inverted U-shape; and said tail anvil means and said lower crimping means are in contact with and slidable along the legs of said frame.

7. The crimping tool head as defined in claim 6 further characterized in that said tail crimping means is mounted on the cross-member of said frame with its guiding surface opposing the compressing surface of said tail anvil means.

8. The crimping tool head as defined in claims 1 or 6 further including terminal holder means, coupled to said tail anvil means, for positioning the section of said contact to be crimped between the opposing surfaces of said upper and lower crimping means and for positioning the tail section between the opposing surfaces of said tail crimping means and said tail anvil means.

9. The crimping tool head in accordance with claim 8 wherein said terminal holder means further includes means for moving said terminal holder means between an engaged position and a disengaged position, said terminal holder in abutting contact with said lower crimping means when in the engaged position and remote from said lower crimping means when in the disengaged position, wherein said contact is properly positioned to be crimped when said terminal holder means is in the disengaged position.

10. The crimping tool head in accordance with claim 8 wherein said upper crimping means includes:

insulation support crimper means for guiding the formation of the section of said contact which is to be crimped onto the insulated portion of said wire; and wire barrel crimper means, coupled to said insulation support crimper means, for guiding the formation of the section of said contact which is to be crimped onto the stripped portion of said wire.

11. The crimping tool head in accordance with claim 10 wherein said upper crimping means further includes hold down means, positioned between said insulation support crimper means and said wire barrel crimper means and slidably seated in a track in said insulation support crimper means, for maintaining said contact in position against said lower crimping means as said lower crimping means is engaged with said upper crimping means.

12. The crimping tool head in accordance with claim 10 wherein the surface of said tail anvil means opposing the surface of said tail crimper means is characterized as having a rectangular shaped cavity, the base of said cavity including an inclined planar shaped projection.

13. The crimping tool head in accordance with claim 12 wherein the surface of said tail crimper means opposing the surface of said tail anvil means is characterized as having a rectangular shaped member, said member matable with the cavity in the opposed surface of said tail anvil means.

14. The crimping tool head in accordance with claim 13 wherein the surface of said projecting rectangular shaped member is characterized as having a notch to accommodate said inclined planar shaped projection and said wire.

* * * * *